US005519920A

United States Patent [19]

Runge et al.

[11] Patent Number: 5,519,920

[45] Date of Patent: May 28, 1996

[54] HINGE

[75] Inventors: Friedhelm Runge, Wuppertal; Manfred Sauerland, Essen, both of Germany

[73] Assignee: EMKA Beschalagteile GmbH & Co. KG, Velbert, Germany

[21] Appl. No.: 313,283

[22] PCT Filed: Apr. 1, 1993

[86] PCT No.: PCT/DE93/00320

§ 371 Date: Nov. 30, 1994

§ 102(e) Date: Nov. 30, 1994

[87] PCT Pub. No.: WO93/20318

PCT Pub. Date: Oct. 14, 1993

[30] Foreign Application Priority Data

Apr. 1, 1992 [DE] Germany ..... 42 10 803.9

[51] Int. Cl.[6] ..... E05D 3/06; E05D 3/10; E05D 15/32

[52] U.S. Cl. ..... 16/367; 16/366; 16/370; 16/221

[58] Field of Search ..... 16/367, 221, 366, 16/370

[56] References Cited

U.S. PATENT DOCUMENTS 4,821,375 4/1989 Kozon ..... 16/370

4,929,146 5/1990 Koster et al. ..... 16/370

FOREIGN PATENT DOCUMENTS 0206035 12/1986 European Pat. Off. .

4035199 5/1992 Germany .

2238577 6/1991 United Kingdom .

*Primary Examiner*—Maurina T. Rachuba

*Assistant Examiner*—Adesh Bhargava

*Attorney, Agent, or Firm*—Robert W. Becker & Associates

[57] ABSTRACT

A hinge for holding two components, such as a cabinet and its door or the like, that are supported so as to pivotable relative to one another about the axis of the hinge. The hinge has a hinge support that is disposed on one of the components and has two aligned eyelets. A hinge bolt is connected to the other component and extends through the eyelets in order to connect the components. To be able to displace the components relative to one another, the hinge bolt is fixedly connected to its component and the eyelets are attached to the hinge bolt via pivotable connected rods such that the eyelets are displaceable along an axis of the hinge bolt, with the hinge bolt having such a configuration that rotation of the hinge bolt effects displacement of the eyelets.

11 Claims, 3 Drawing Sheets

HINGE

BACKGROUND OF THE INVENTION

The present invention relates to a hinge for holding two components, such as a cabinet and its door or the like, that are supported so as to be pivotable relative to one another about an axis of the hinge, with a hinge support that is disposed on one of the components and has two aligned eyelets, and with a hinge bolt that is connected to the other component and extends through the eyelets in order to connect the components.

Hinges of this general type have been used; with such hinges, a sleeve associated with a hinge flange that is secured to one of the components customarily extends between the aligned eyelets of the hinge support that is mounted on the other component, with a connection of the components being effected by a hinge bolt that extends through the eyelets of the hinge support and the sleeve of the hinge flange. Thus, one of the components is held on the other so as to be pivotable relative thereto about the axis established by the hinge bolt.

Such known hinges have the drawback that this axis of rotation of the hinge remains fixed in every position of the two components relative to one another, so that the two components that are connected by the hinge must rest against one another in the region of the hinge in every position relative to one another. Thus, it is not possible to realize hinge objectives where, for example, a displacement of one of the components relative to the other component during pivoting thereof is desired. For example, with certain arrangements for example of a cabinet, preferably a control-cabinet, having a door, it can be desirable for the door to lift off from the cabinet section by a certain amount when the door is opened.

A hinge of the aforementioned general type is disclosed in DE 40 35 199 A1, where a possibility of displacement of the hinge bolt arrangement is proposed in that the hinge sleeve that receives the hinge bolt is displaceably disposed on the associated hinge part via a shift piece, so that the position of the hinge bolt can be appropriately freely established. However, this known possibility for displacement does not permit displacement of the hinge bolt simultaneously with the swinging or pivoting movement of the hinge.

It is therefore an object of the present invention to provide a hinge of the aforementioned type that permits a mutual displacement of the components, such as a cabinet and its door or the like, that are connected via the hinge during the pivoting movement.

SUMMARY OF THE INVENTION

The invention provides in particular that the eyelets are attached to the hinge support via pivotable connecting rods such that the eyelets are displaceable along the axis of the hinge bolt, and that the hinge bolt is fixedly connected to the pertaining component and has a configuration such that rotation of the hinge bolt effects displacement of the eyelets. The inventive configuration has the advantage that rotation of, for example, a door allows the hinge bolt that is connected therewith to also turn, as a result of which the eyelets that are rotationally linked to the hinge support via connecting rods move along the axis of the hinge bolt; depending upon the position of the connecting rods that carry the eyelets relative to the hinge support, there results a variable distance between the hinge bolt and the hinge support, so that the components that are connected to the hinge bolt and the hinge support respectively also assume a varying distance relative to one another. In this way, during rotational or swinging movement of one of the components, it is possible to effect a simultaneous displacement of its position relative to the other component in that the axis of rotation is displaced relative to itself.

Pursuant to one specific embodiment of the invention, in the closed position of the hinge, with the components resting against one another, the eyelets are disposed on the outer ends of the hinge bolt and are moved in opposite directions toward one another by rotation of the hinge bolt. In so doing, due to the connecting rods that are pivotably linked to the eyelets, the distance of the hinge bolt to the hinge support increases. Alternatively, the same effect can, for example, also be produced if the eyelets are attached to the hinge support via a parallelogram-shaped connecting rod, because then also a displacement of the eyelets effects a displacement of the hinge bolt.

Pursuant to another specific embodiment of the invention, the hinge bolt has a portion embodied as a flat section for mounting to the associated component, whereby both ends of the aforementioned portion of the hinge bolt are embodied as rotary spindles that extend through the eyelets of the hinge support. If the flat section of the hinge bolt is, for example, screwed onto the associated component, there results a fixed connection of the hinge bolt with the component. The embodiment of the two end portions of the hinge bolt in a rotary spindle like manner allows the eyelets to be displaced over the longitudinal axis of the hinge bolt when the bolt is rotated.

The rotary spindle portions of the hinge bolt are preferably embodied in such a way that the flat section of the central portion of the hinge bolt is bent into a helical shape, whereby the thus-formed spirals extend through openings provided in the eyelets that are linked to the hinge support.

The openings or apertures of the eyelets that are pivotably connected to the associated connecting rods are appropriately provided, for the hinge bolts, with a rectangular cross-sectional area, the dimensions of which approximately correspond to the dimensions of the flat strip portion of the hinge bolt, so that the spirals formed from the flat strip section turn in the apertures of the eyelets and the eyelets can, as a result, be displaced.

Pursuant to another specific embodiment of the invention, the hinge bolt is provided with a helical thread, and the eyelets are embodied as sleeves that are seated on the hinge bolt and have an allied internal thread; with such a configuration, the smooth-operation of the corresponding displacement movement can be improved.

In this connection, pursuant to a preferred further improved specific embodiment of the invention, the hinge bolt has a thread passage for receiving a ball in a guided manner, and the pertaining eyelet is embodied as a sleeve that is seated on the hinge bolt and has fixedly disposed therein a guide ball that engages the thread passage of the hinge bolt; such a ball guidance improves the ease of operation of the displacement movement even further. In an appropriate specific embodiment of the invention, a number of thread passages can be disposed on the outer periphery of the hinge bolt, with a number of guide balls being associated therewith in the sleeves that extend around the hinge bolt. The thread passages expediently extend helically.

Pursuant to another specific embodiment of the invention, the connecting rods are arranged in a scissors-like pattern between the hinge support and the eyelets or sleeves of the hinge, thereby reducing the space required for installation when the hinge is closed. Pursuant to another specific embodiment of the invention, for guiding the scissors-like connecting rods, the hinge support in this connection is embodied as a double-C-bar having a guide slot for the enclosed guidance of the connecting rods.

To the extent that an inventive hinge is also to be embodied for the unhooking or removal of a hinge part, preferably the cabinet door, it is expedient to embody the hinge support as a U-shaped housing for receiving the journal pins of the connecting rods, whereby the one open side of the housing is closed off with a releasable stop means, so that after removing this stop means the connecting rods with the associated journal pins can be removed from the hinge support, so that to this extent the parts of the hinge can be detached from one another, as is necessary when hanging a door.

BRIEF DESCRIPTION OF THE DRAWINGS

The drawings show specific embodiments of the invention, which will be described subsequently. Shown are.

DESCRIPTION OF PREFERRED EMBODIMENT

Figure 1:
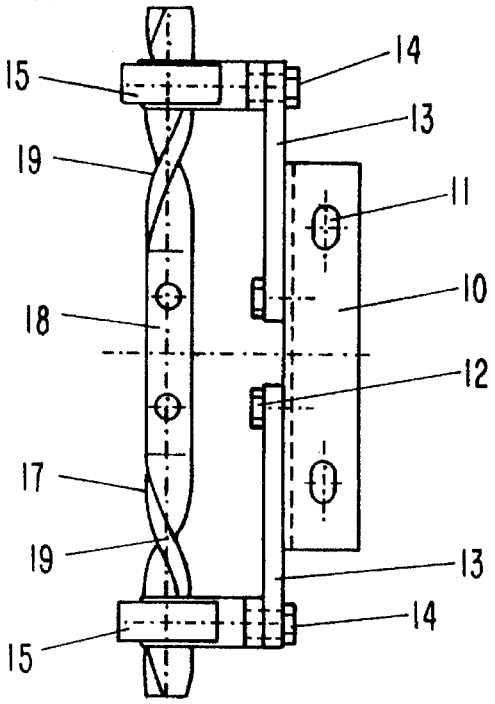
FIG. 1 a front view of a hinge in the closed position.

In FIGS. 1 to 5 only the individual parts of the hinge are first illustrated in a simplified form without the associated components as the carriers of the hinge also being illustrated.

The hinge comprises a hinge support 10 that, via non-illustrated mounting means that extend through mounting holes 11, is to be secured to one of the two components that are to be connected by the hinge, for example, a cabinet. Secured to the hinge support 10 via screws or bolts 12 are connecting rods 13 that are pivotable about the axes of the screws. The other ends of the connecting rods are similarly pivotably connected via pertaining mounting means 14 to respective eyelets 15. The eyelets 15 are provided with apertures 16 (FIG. 5) for a hinge bolt 17.

The central portion of the hinge bolt 17 comprises the portion 18 that is embodied as a flat section. Adjoining both ends of the flat central portion 18 are portions embodied in the manner of rotary spindles 19 via which the hinge bolt 17 extends through the apertures 16 of the two eyelets 15. To form the rotary spindle 19, the flat section of the portion 18 is twisted into a spiral.

The apertures 16 in the eyelets 15 are appropriately provided with a rectangular cross-sectional area that corresponds approximately to the dimensions of the flat section of the portion 18 of the hinge bolt 17, thus permitting a rotation of the rotary spindles 19 of the hinge bolt 17 in the apertures 16.

Figure 2:
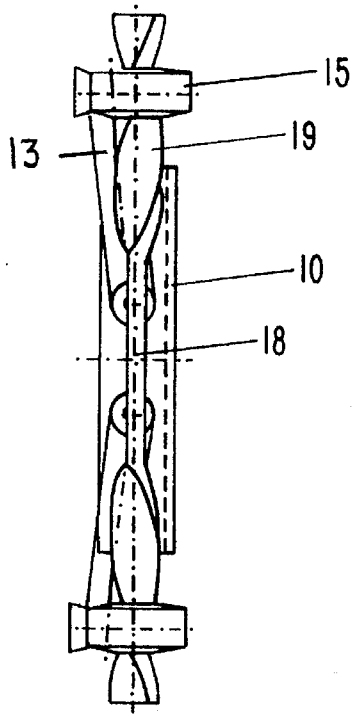
FIG. 2 a side view of the subject matter of FIG. 1.
Figure 3:
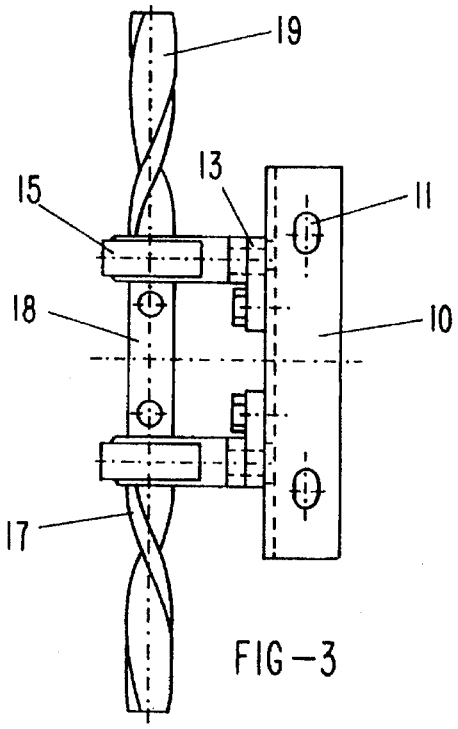
FIG. 3 a front view of a hinge in the open position.
Figure 4:
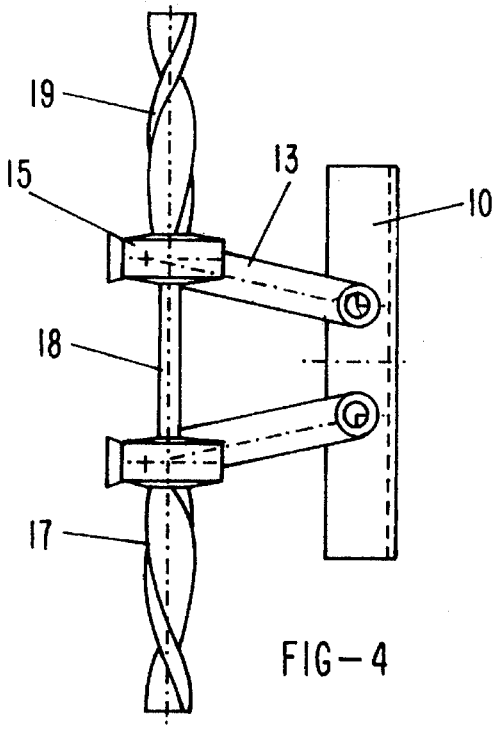
FIG. 4 a side view of the subject matter of FIG. 3.
Figure 5:
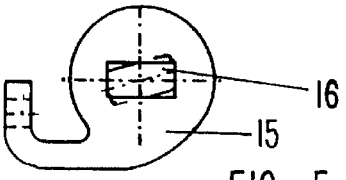
FIG. 5 a plan view of an eyelet of the hinge support.
Figure 6:
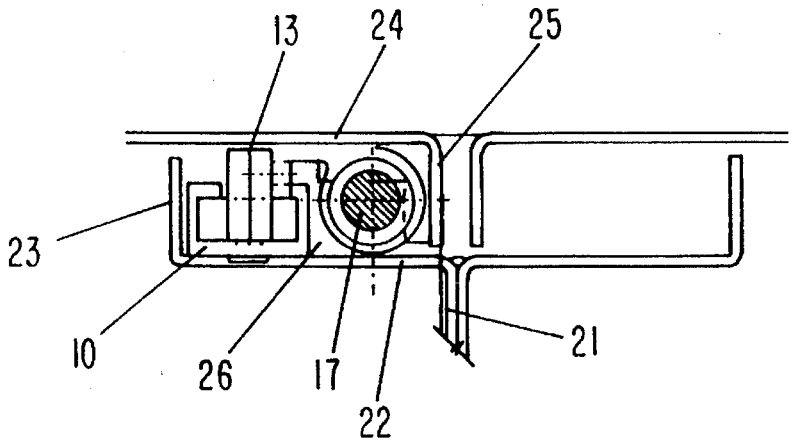
FIG. 6 the installed state of a further exemplary embodiment of the hinge with the hinge retracted, FIG. 6*a* front view of the hinge of FIG. 6, FIG. 7 the installed state of the hinge embodiment illustrated in FIG. 6 with the hinge swung out, FIG. 7*a* a front view of the hinge of FIG. 7.
Figure 7:
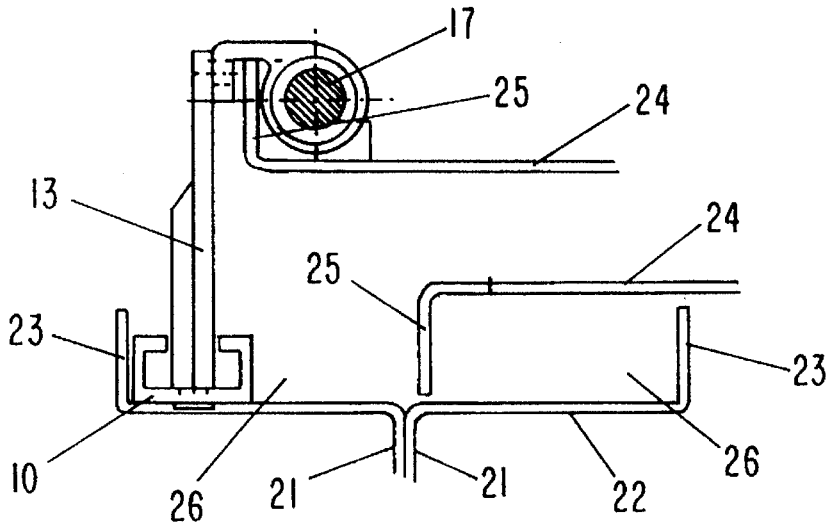

FIGS. 1 and 2 illustrate the closed position of the hinge with a straight position of the connecting rods 13, whereby the distance of the hinge bolt 17 from the hinge support 10 has its least value, so that the components that are respectively connected to the parts of the hinge are oriented so as to rest against one another. When the hinge bolt 17 is rotated by 180 degrees into the position illustrated in FIG. 3, the eyelets 15 are shifted along the rotary spindles 19 of the hinge bolt 17 in opposite directions relative to one another, taking the connecting rods 13 with them, so that a corresponding parallel displacement of the hinge bolt 17 relative to its own position, and an increase of the distance of the hinge bolt 17 from the hinge support 10, result. As can be seen in particular from FIG. 4, when a component, for example a door, has swung out by 180 degrees, this door has lifted off from the cabinet section, as carrier of the hinge support, by the distance effected by the position of the connecting rods 13. To effect closing, the hinge bolt 17 is again rotated back into the starting position shown in FIG. 1, as a result of which a displacement of the eyelets 15 in an outward direction results, with the eyelets thus again conveying the connecting rods 13 into the straight position relative to the hinge support 10 accompanied by a reduction of the distance of the hinge bolt 17 from the hinge support 10. FIGS. 6 and 7 illustrate a structurally advanced embodiment of the invention where the hinge is embodied as an internal hinge having an opening angle of 180 degrees, as is expedient for use of the hinge for cabinets that are to be arranged in a row. As can be seen from FIG. 6, the hinge is disposed in a corner area 26 of a cabinet, preferably a control-cabinet that is made of thin sheet metal, with this corner area 26 being formed between a door 24 having an angled-off portion 25, and a projecting strip 23 of the cabinet body that is disposed at an offset 22 relative to the side wall 21. When the door 24 is swung open, the position seen in FIG. 7 results, where it can be clearly seen that the door 24 lifts off from the cabinet body, so that an appropriate free space for the swinging open of the door 24 in front of the associated door of the adjacent cabinet is provided.

Figure 6A:
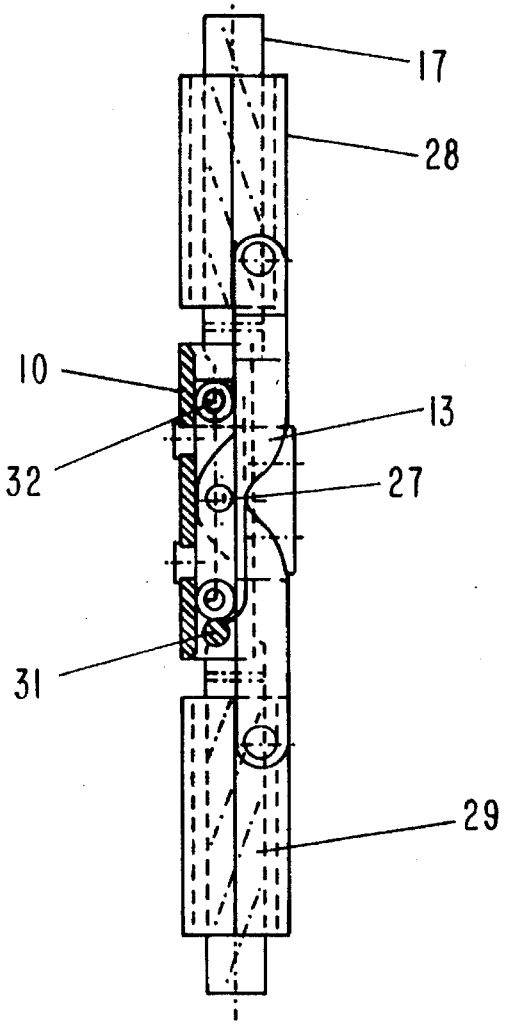
Figure 7A:
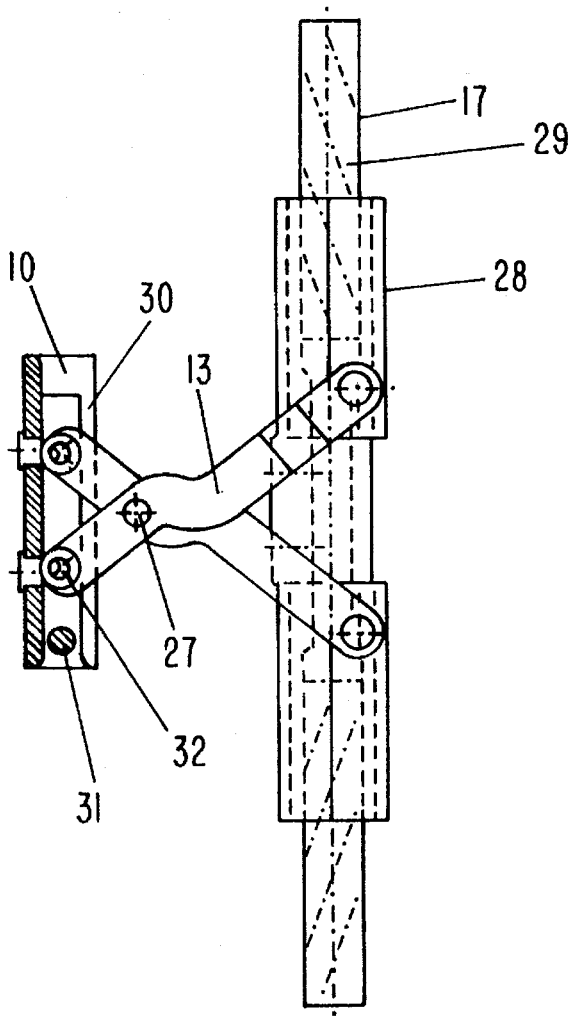

As can be seen in detail in FIGS. 6*a*, 7*a*, the hinge support 10 that is mounted to the cabinet body is embodied as a double-C-shaped bar in which the connecting rods 13 are held and guided via associated journal pins 32 and extend out of the hinge support 10 through an associated elongated slot in the bar section. The connecting rods 13 are arranged in a scissors-like pattern with a scissor point of rotation 27. As indicated in the drawings, with the illustrated embodiment the eyelets that are displaceable on the hinge bolt 17 during an opening movement of the door are embodied as sleeves 28 that surround the hinge bolt 17. The particularly smooth operation guidance of the sleeves 28 on the hinge bolt 17 results from the fact that the peripheral surface of the hinge bolt 17 is provided with a plurality of helical thread passages 29 in which travel balls that are fixedly mounted within the sleeves 28. In this connection, it can be expedient, rather than mounting the appropriate guide balls on the sleeve 28 itself, to dispose an additional inner sleeve for this purpose in the sleeve 28.

As can be seen particularly clearly from FIG. 7*a*, the double-C-shaped bar form of the hinge support 10 is embodied in the longitudinal direction of the hinge as a U-shaped housing 30, the open side of which is closed off by a releasable stop means 31 in such a way that the connecting rods 13 with the associated journal pins 32 are held and guided in the housing 30. If the stop means 31 is removed from the housing 30 of the hinge support 10, the connecting rods 13 can be pulled out of the hinge support 10, thus enabling disassembly of the hinge parts from one another, resulting in being able to remove the door 24 from the body of the cabinet.

The present invention is, of course, in no way restricted to the specific disclosure of the specification and drawings, but also encompasses and modification within the scope of the appended.

We claim:

1. A hinge for holding two components that are supported so as to be pivotable relative to one another about an axis of the hinge, said hinge comprising:

a hinge support that is disposed on one of said components and has two aligned eyelets; and a hinge bolt that is fixedly connected to the other of said components and extends through said eyelets in order to connect said two components, whereby said eyelets are attached to said hinge support via pivotable connecting rods such that said eyelets are displaceable along an axis of said hinge bolt, and whereby rotation of said hinge bolt effects a simultaneous displacement of said eyelets and hence of said hinge bolt and its other component relative to said hinge support and its one component.

2. A hinge according to claim 1, wherein, for connection to its component, said hinge bolt is provided with a portion embodied as a flat section, and wherein opposite ends of said portion of said hinge bolt are embodied as respective rotary spindles that extend through said eyelets of said hinge support.

3. A hinge according to claim 2, wherein to form said rotary spindles, said opposite ends of said flat section portion of said hinge bolt are bent into helical forms, with said helical forms disposed at said two ends of said hinge bolt extending through said eyelets of said hinge support.

4. A hinge according to claim 2, wherein said eyelets are rotatably connected to respective ones of said connecting rods, and wherein said eyelets are provided with respective apertures for said hinge bolt, with said apertures having a rectangular cross-sectional area with a dimension that corresponds at least approximately to dimensions of said flat section portion of said hinge bolt.

5. A hinge according to claim 1, wherein in a closed position of said hinge said components rest against one another and said eyelets are disposed at outer ends of said hinge bolts and said connecting rods are disposed in a straight position, and wherein rotation of said hinge bolt effects movement of said eyelets in opposite directions toward one another along said axis of said hinge bolt.

6. A hinge according to claim 1, wherein said hinge bolt is provided with a helical thread, and wherein said eyelets are embodied as sleeves that are seated on said hinge bolt and are provided with cooperating internal threads.

7. A hinge-according to claim 1, wherein said hinge bolt is provided with at least one thread passage for receiving a guide ball in a guided manner, and wherein said eyelets are embodied as sleeves that are seated on said hinge bolt and have disposed therein respective guide balls that engage said at least one thread passage of said hinge bolt.

8. A hinge according to claim 7, wherein said hinge bolt is provided with a plurality of thread passages and said sleeves are provided with a plurality of cooperating guide balls.

9. A hinge according to claim 1, wherein said connecting rods are disposed in a scissors-like pattern between said hinge support and said eyelets.

10. A hinge according to claim 9, wherein to effect guidance of said scissors-like connecting rods, said hinge support is embodied as a double-C-section bar that receives journal pins of said connecting rods and is provided with a guide slot for an enclosed guidance of said connecting rods.

11. A hinge according to claim 21, wherein said hinge support is embodied as a U-shaped housing that extends in a longitudinal direction of said hinge, with said housing having an open end in which is disposed a releasable stop means for fixing the position of said journal pins of said connecting rods in said housing.

* * * * *